United States Patent [19]

Goidinger

[11] 4,285,179

[45] Aug. 25, 1981

[54] PLATE SHAPED PREFABRICATED GUILDING ELEMENT AND A PROCESS FOR THE PRODUCTION OF WALLS BY USING THESE ELEMENTS

[76] Inventor: Johann Goidinger, A-6511 Zams, Hinterfeldweg 8, Austria

[21] Appl. No.: 90,256

[22] Filed: Nov. 1, 1979

[30] Foreign Application Priority Data

Mar. 10, 1975 [AT] Austria .... No. A 1850/75

Related U.S. Application Data

[63] Continuation-in-part of Ser. No. 892,875, Mar. 31, 1978, abandoned, which is a continuation of Ser. No. 621,045, Oct. 9, 1975, abandoned.

[51] Int. Cl.[3] ..... E04B 2/24; E04B 2/26

[52] U.S. Cl. ..... 52/309.12; 52/437; 52/605; 52/606; 52/743; 52/747

[58] Field of Search ..... 52/309.12, 437, 438, 52/605, 606, 309.17, 306, 743, 747; 260/29.6 S, 42.13; 521/83, 100

[56] References Cited

U.S. PATENT DOCUMENTS

| | | | |
|---|---|---|---|
| 1,445,713 | 2/1923 | Reilly | 52/438 |
| 1,682,360 | 8/1928 | Straub | 52/606 X |
| 2,114,732 | 4/1938 | Anderegg | 52/306 |
| 2,296,002 | 9/1942 | Tym | 52/606 |
| 2,299,552 | 10/1942 | McGregor et al. | 260/29.6 S |
| 2,333,723 | 11/1943 | Jordan | 52/437 X |
| 2,851,873 | 9/1958 | Wheeler-Nicholson | 52/438 |
| 3,247,294 | 4/1966 | Sabouni | 52/612 X |
| 3,416,276 | 12/1968 | Caputo et al. | 52/606 |
| 3,611,667 | 10/1971 | Maxwell, Sr. | 52/747 |
| 3,705,117 | 12/1972 | Vargiu et al. | 521/100 X |
| 3,899,455 | 8/1975 | Unterstenhoefer | 521/83 |

FOREIGN PATENT DOCUMENTS

| | | | |
|---|---|---|---|
| 714601 | 7/1965 | Canada . | |
| 857937 | 12/1970 | Canada . | |
| 1907959 | 9/1970 | Fed. Rep. of Germany . | |
| 2063206 | 7/1971 | Fed. Rep. of Germany | 521/83 |
| 1066787 | 4/1967 | United Kingdom . | |
| 1286897 | 8/1972 | United Kingdom . | |
| 1300457 | 12/1972 | United Kingdom . | |
| 1316732 | 5/1973 | United Kingdom . | |
| 1328746 | 8/1973 | United Kingdom . | |
| 1333487 | 10/1973 | United Kingdom . | |

*Primary Examiner*—Alfred C. Perham
*Attorney, Agent, or Firm*—McGlew and Tuttle

[57] ABSTRACT

A substantially crack-free load-bearing wall of prefabricated building elements and method of producing the same comprising a plurality of pre-fabricated building elements made of light-weight concrete each having a modulus of elasticity less than 8,000 kg/cm$^2$. The elements are substantially rectangular in shape and have longitudinal grooves on their respective longitudinal edges. The elements are first shrunk by steam hardening or by storage for a pre-selected period of time and then arranged side by side with their lateral side edges in abutting relationship so that the grooves of the respective adjacent elements form vertical channels therebetween. The channels are filled with heavy concrete which provides a tensile-resistant bond between the elements and which also forms pillars which carry the major part of any load applied to the wall.

22 Claims, 7 Drawing Figures

PLATE SHAPED PREFABRICATED GUILDING ELEMENT AND A PROCESS FOR THE PRODUCTION OF WALLS BY USING THESE ELEMENTS

CROSS REFERENCE TO RELATED APPLICATIONS

The present application is a continuation in part of the inventor's previous application having Ser. No. 892,875 filed Mar. 31, 1978, now abandoned, which itself was a continuation application of Ser. No. 621,045 filed Oct. 9, 1975 now abandoned.

FIELD AND BACKGROUND OF THE INVENTION

The present invention relates in general to wall structures made of pre-fabricated elements and, in particular to a new and useful substantially crack-free-load-bearing wall construction of pre-fabricated elements and method of producing the same.

In the building industry the use of pre-fabricated building elements has recently become more widespread. The object is to save time and money by producing large pre-fabricated elements which are assembled on the building site in a relatively short construction time.

For load-bearing walls, it is generally necessary to use, pre-fabricated elements of heavy concrete. Such elements have, up to now, therefore only been used for very large constructions where cranes capable of lifting the heavy weights of these elements are available. The weight of a pre-fabricated wall of heavy concrete of the dimensions 4 m/2.5 m/0.3 m, amounts to about 7.5 (metric) tons. A further disadvantage of pre-fabricated elements of heavy concrete is that they provide only a very limited amount of heat-insulation.

When the elements are assembled on site, expansion joints must be provided between the adjacent elements to allow for their expansion and contraction. These joints can be closed by elastic mastic sealing bands, and the like. In spite of these expansion joints, inner tensions build up and cause cracks in the walls which are not only ugly, but also have an adverse affect on the strength of the wall. As such walls are usually plastered, the cracks in the concrete and at the expansion joints become visible cracks in the plaster on the wall.

Pre-fabricated wall constructions are also known utilizing a plurality of pre-fabricated panel elements which have shaped edges. When such elements are abutted against each other to form a wall, the shaped edges form columns between adjacent panels which can be filled with reinforced concrete or the like for producing a load bearing framework for the panels. The panels themselves can be made with cut out portions to reduce their weight. In such construction, cracks may readily form in the area between adjacent panels due to uneven expansion between material of the panels and the material of the supporting columns. In such constructions special provisions must also be made for providing expansion joints and the like between adjacent panels since cracks will otherwise invariably form.

SUMMARY OF THE INVENTION

An object of the present invention is to provide a method of constructing a load-bearing wall of pre-fabricated building elements in which the above problems are alleviated.

Another object of the present invention is to provide a substantially crack-free load-bearing wall of pre-fabricated building elements of light-weight concrete each having a modulus of elasticity of less than 8000 kg/cm$^2$ which have been previously shrunk by steam-hardening or storage, each of the elements having a lengthwise groove formed on each of their longitudinal side edges, with the elements further being arranged in side by side orientation so that the longitudinal side edges of adjacent elements are in abutting relationship and the grooves form vertical columns which are filled with heavy concrete to provide tensile-resistant bonds between the adjacent elements and to form pillars in the columns which carry the major part of the load applied to the wall. The amount of previous shrinkage for each of the pre-fabricated elements is selected so that the residual shrinkage remaining is accommodated by the creep or flow of the elements as they are exposed to internal tensile forces and by the elastic expansion of the elements.

Accordingly, the present invention provides a method of constructing a substantially crack-free load-bearing wall, comprising providing a plurality of substantially rectangular pre-fabricated building elements of light-weight concrete having a modulus of elasticity of less than 8000 kg/cm$^2$ which have been previously shrunk by steam-hardening or storage, the elements having a lengthwise groove formed in each of their longitudinal side edges. These element are arranged side-by-side so that the longitudinal side edges of adjacent elements are in abutting relationship and the grooves form vertical channels between adjacent elements. The channels are then filled with heavy concrete to provide a tensile-resistant band between adjacent elements which hold adjacent elements together and to form pillars which carry the major load applied to the wall. The previous shrinkage of the elements is such that the residual shrinkage of the elements is accommodated by creep occurring in the elements and by the elastic expansion thereof. The lightweight concrete may include expanded polystyrene.

The present invention also provides a substantially crack-free load-bearing wall construction comprising a plurality of the substantially rectangular pre-fabricated building elements of light-weight concrete as described and connected to each other above.

Owing to the use of lightweight concrete, the pre-fabricated element of the load-bearing wall have a weight of about one quarter that of heavy concrete elements of the same size.

It is also possible to produce the pre-fabricated elements in different sizes in order to construct load-bearing walls of differing lengths. The low weight would, for example, permit walls of the length of breadth of a room to be made. In a pre-fabricated wall of the dimensions specified above the weight is reduced to about 1.8 to 1.9 tons, which permits these parts to be handled in a relatively simple way.

The pre-fabricated elements may also be provided with longitudinal channels extending therethrough. The distance between the channels normally amounts to about 5 cm. According to the load that has to be borne, none or several of the channels may be filled with heavy concrete to form additional load-carrying pillars.

The cross section of the channels can have any form. For example, they may be round with a diameter of 15 cm, square, or rectangular. The heavy concrete filled into the channels can be reinforced.

In a further embodiment the channels of the wall element are arranged assymmetrically with respect to a plane of symmetry which is arranged parallel to its exterior surfaces. This embodiment is specially suited to form external walls. The wall elements are put up on the site in a way as to have the distance between the lateral surfaces of the elements and the channels smaller towards the interior of the building and bigger towards the exterior thereof in order to achieve a better heat-insulation since the thicker layer of light-weight concrete is adjacent the exterior of the building.

In a further preferred embodiment of the invention, the building element has, on at least at one of its supporting surfaces, a projecting rim. This rim, which exceeds the height of the wall element, provides a lateral sheath for the ceiling while at the same time helping to prevent temperature jumps between the single superposed wall elements of different stories.

The pre-fabricated building elements have a low modulus of elasticity of less than 8000 kg/cm$^2$, preferably 4000 kg/cm$^2$. Their vertical edges are preferably activated so as to increase their adhesion with the heavy concrete. In conventional pre-fabricated building elements of light-weight concrete, it was thought desirable to have a high compressive strength which was brought about by addition of certain materials. This, however, entailed also a higher volumetric weight of the pre-fabricated elements as well as a relatively high modulus of elasticity of at least 8000 kg/cm$^2$. It is noted that in the metric system the units of the modulus of elasticity is usually in kp/cm$^2$ which represents kilo-pond per centimeters square. The kilo-pond is a unit of force however, to avoid confusion in English texts, this unit of force which might be confusing is, by convention, changed to the unit of mass kilograms. It is noted that the kilo-pond is equivalent to a kilogram in the gravitational field of the earth so that the units are consistent. In the present invention, the major part of the load is carried by the concrete pillars and the compressive strength of the light-weight concrete is of less importance.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The present invention will be described in more detail, by way of example only, with reference to the accompanying drawings, in which.

DESCRIPTION OF THE PREFERRED EMBODIMENTS

Figure 1:
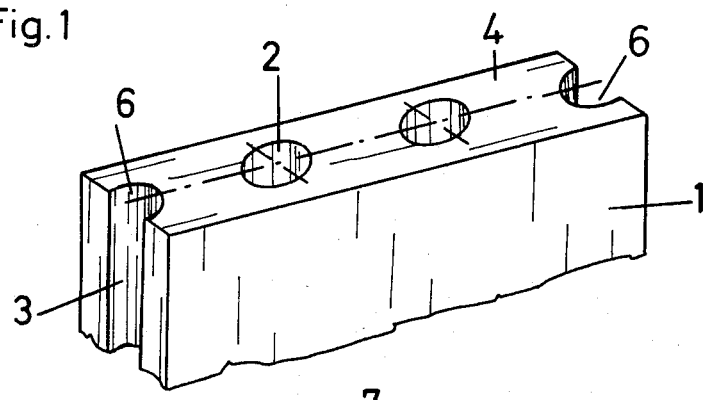
FIG. 1 is a perspective view of one end of a pre-fabricated building element.

A pre-fabricated building element such as that shown in FIG. 1 may be made of a light-weight concrete in which expanded polystyrene is used and of which one m$^3$ contains the following ingredients:

| | |
|---|---|
| 1100 l | foamed polystyrene particles |
| 340 kg | cement |
| 40 kg | fine sand (grain size 0–0.5 mm) |
| 130 l | water |
| 0,365 kg | adhesive material |
| 0,135 kg | hardener |

An epoxy resin is used as adhesive material, which is produced by the Shell Chemical Co. under the name "Epikote" (German trademark No. 633.215).

A greater number of other epoxy resins and other organic compounds also can be used as adhesive materials. Examples thereof are:

an organosiloxanol as described in detail in British Patent Specification No. 1,066,787.

an aqueous dispersion comprising a polyepoxide compound and a monoepoxide compound, the latter being chosen from among the alkyl glycidyl eithers and aryl glycidyl ethers, as described in detail in British Specification No. 1,286,897. "Epicure", which is also produced by the Shell Chemical Co. (German trademark No. 635.517), was used as a hardener adapted to the adhesive material. The hardeners vary according to the type of resin. Most of them are amines or polyamines.

After a storage of about 90 days such a pre-fabricated building element of light-weight concrete has a volumetric weight of about 500 kg/m$^3$, a compressive strength of 15 kg/cm$^2$ and the following further characteristics:

| | |
|---|---|
| residual shrinkage (about 30% of the total shrinkage) | 0.85 mm/m |
| modulus of elasticity | 4000 kg/cm$^2$ |
| tensile strain | 2 kg/cm$^2$ |
| creep or flowing factor | 0.4 mm/m |

The creep factor of such a pre-fabricated building element represents the amount of plastic deformation that will occur, over a period of time, under tensile stress induced by shrinkage, and may amount to as much as 2 mm/m. The initial shrinkage of the pre-fabricated building elements can also be attained by a conventional steamhardening process instead of storage.

Figure 5:
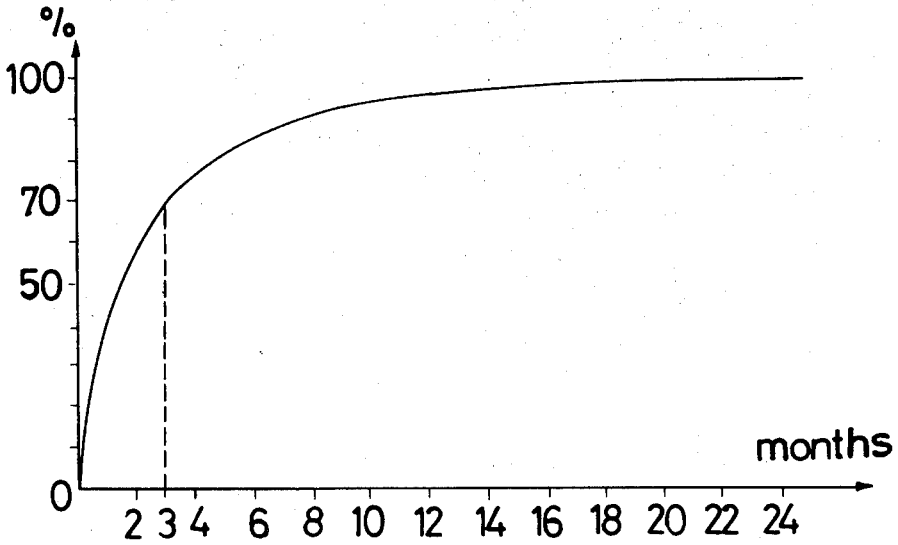
FIG. 5 is a graph showing the amount of shrinkage of the building elements plotted against time.

On referring to FIG. 5, it will be seen that the shrinkage of the building elements approaches a final value asymptotically with time. In the example given, the total amount of shrinkage over a long time is 2.85 mm/m. The first 2 mm/m, that is, approximately the first 70% of the total shrinkage, occurs during the first 90 days, leaving the residual shrinkage of 0.85 mm/m to occur over a long period of time. The low modulus of elasticity of the concrete allows for an elastic expansion of the concrete of about 0.5 mm/m. To this is added the creep of the concrete which amounts to a minimum of 0.4 mm/m and may be as high as 2 mm/m. It can be seen that the sum of the minimum creep factors and maximum elastic expansion is equal to 0.9 mm/m. This exceeds the maximum residual shrinkage of the concrete which is 0.85 mm/m, and consequently cracks do not occur. Furthermore, the increased elasticity of the concrete is sufficient to compensate for the continuous expansion and contraction of the concrete due to temperature and humidity changes and the like.

The wall elements of this invention and the walls produced by the method of this invention thus remain without fissures even after a longer period of time and corresponding aging. Therefore it is not at all necessary to provide adjustment-joints as is usually the case with prior art walls of pre-fabricated elements.

The pre-fabricated building elements according to the invention, produced of light-weight concrete in which expanded materials are utilized, can be formed in very exact dimensions and have particularly even and smooth lateral surfaces, which means that further treatment or lining, which is necessary in most other construction systems, is reduced to a minimum. The inner walls need only be formed or, if needed, made smooth whereupon wallpaper or paint can be directly applied. For outer walls it is only necessary to apply a layer of sprayed plaster.

Referring now specifically to the drawings, the wall element 1 is produced of concrete containing expanded materials, for example polystyrene, as described above. The element is provided with vertical grooves 6 extending over its total height in its side edges 3, and longitudinal internal channels 2 extending through it. The cross section of the channels 2 is preferably circular. They may however, have any other shape. In the embodiments according to the FIGS. 1 and 2, the channels are arranged symmetrically to the two lateral surfaces as well as to the plane of symmetry 7. The longitudinal grooves 2 have cross sections which are such that when the two elements are arranged edge-to-edge, the adjacent vertical grooves form a channel.

Figure 2:
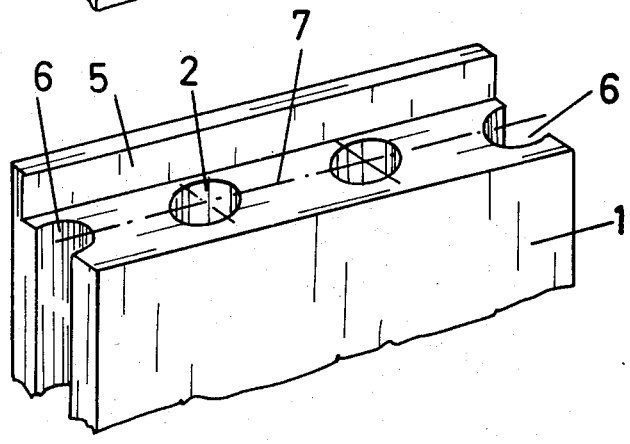
FIG. 2 is a similar view of a modified form of the building element.

In the embodiment according to FIG. 2, the upper loadbearing surface 4 of the wall element 1 is provided with rim 5 projecting over the height of the element 1. The rim 5 can represent the sheathing for a ceiling that lies on the supporting surface 4, as well as for preventing temperature jumps at the ceiling joints.

The channel 2 preferably has a diameter of at least 15 cm. The diameter as well as the number of the internal channels 2 depends on the desired stability of the loadbearing wall. Some or all of the channels 2 can be filled with heavy concrete. The distance between the channels 2 amounts, for example, to 5 cm.

It is also possible to have several channels, not only side by side on the plane of symmetry 7, but also, for example, in two symmetric lines or staggered against each other. In order to reinforce the channel 2, it is also possible to provide reinforcements which are not represented in the figures but may be, for example, iron rods or re-bars and the like.

Figure 3:
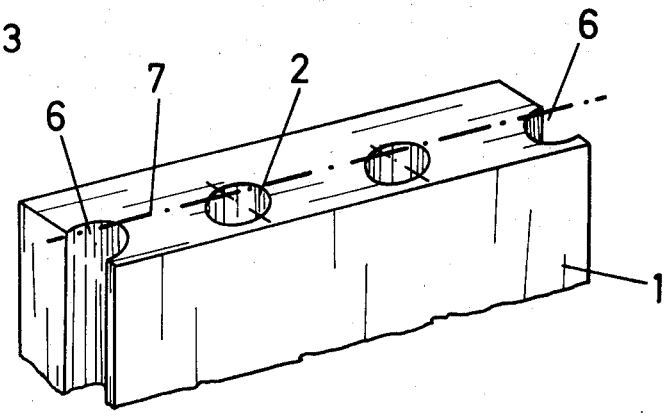
FIG. 3 is again a similar view of a still further modified form of the building element.

In the embodiment according to FIG. 3, the channels 2 are asymmetric with respect to the plane of symmetry 7. Thus, the distance between the channel and one outer surface 10 of the element and final wall construction, is greater than between the channel and the other or inner surfaces 11. This embodiment is specially devised for outer walls of buildings, since heat-insulation can be improved by arranging the thicker layer of light-weight and insulating concrete between the channel 2 and the outer surface 10.

As described above, the wall elements 1 are produced with a breadth of, for example, 1 m, a modulus of elasticity of 4000 kg/cm$^2$ and a creep factor of about 0.4 mm/m. In the event that the elements are not steam hardened, they are stored for about 90 days to make them shrink by about 2 mm/m. The outer surfaces of the longitudinal grooves are roughened, for example by grinding, in order to improve their adhesion with heavy concrete. Alternatively, it is also possible to provide an appropriate layer, for example a layer of pure cement mortar on the surface of the vertical edges 3.

Figure 4:
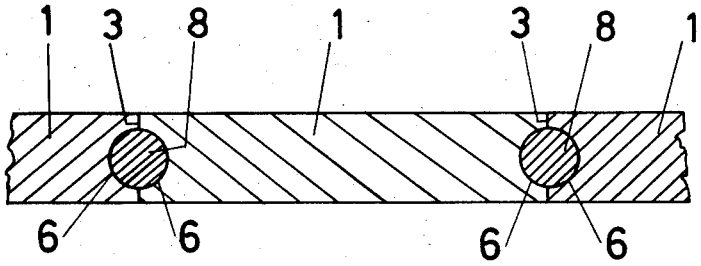
FIG. 4 is a plan view of a portion of a completed wall in accordance with the invention.

The vertical edges 3 should be activated, for example, by roughening, so that an adhesive tension between the heavy concrete pillar and the wall element of up to 3 kg/cm$^2$ and over can be achieved. In this manner, the adhesive tension will be more than the highest possible tensile stress in the building element. No cracks will occur in the joints between the wall elements on the occasion of another wettening and drying of the element during construction or later on, for example, after heavy rainfalls. In order to construct a wall according to the invention, the building elements 1 are arranged side-by-side with the vertical edges 3 in abutting relationship. The grooves of adjacent elements thereby form channels similar to the internal channels 2. The channels formed by the grooves are then filled with a heavy concrete which forms a tensile-resistant bond between the adjacent elements. Furthermore, as shown in FIG. 4, the heavy concrete 8 also forms pillars between the adjacent building elements. FIG. 4 shows the case where there are no internal channels, although clearly building elements having such channels may be joined together, to form a wall in the same manner. In that case, some or all of the internal channels 2 may be filled with the heavy concrete form additional pillars 8.

In view of the very high modulus of elasticity of heavy concrete, compared with the low modulus of the light-weight concrete (less than 8000 kg/cm$^2$), it is clear from FIG. 4 that the major part of any load applied to the wall is carried by the concrete pillars 8. The building elements themselves do not have a major loadbearing function. When the wall is constructed as shown in FIG. 4, the residual shrinkage of 0.85 mm/m is accommodated by the creep factor and elastic expansion of the concrete as described above. Consequently, contrary to expectations, the wall, even though made of relatively flexible light concrete, will not crack. Furthermore, the wall has good heat and sound insulation properties.

The expanded polystyrene may be replaced by other materials, such as for example, expanded schist or clay. The process can also be applied to gas-concrete or the like and wood chip materials.

In the above, the expression tensile-resistant bond means that the bond will not break as a result of tensions that occur in the wall.

This tension resistant bond can be realized in several different ways, such as:

(1) By selectively shaping the abutting edges of adjacent element, that is for example, by forming dovetails in the grooves 6. After the grooves have been filled, with heavy concrete, a tension resistant connection is provided.

(2) By applying a layer of pure cement mortar or cement mortar with a high percentage of cement, immediately after the production of the elements. The cement hardens and forms a rough, irregular surface which provides a good and firm connection with the heavy concrete.

(3) By roughening the lateral edges of the elements before the channels are filled up. Also in this case some sort of shaping for the edges is used, as the binding agent can enter into the irregularities of the surface of the lateral edges.

(4) By applying adhesives as an additional ingredient of the filling, that is binding material. The following are examples therefor: emulsions of polyvinyl acetate, solutions of sulfite-modified melamin resins.

(5) By iron inserts or rods that run in an approximately horizontal direction and extend from the grooves 6, which are ultimately imbedded in the heavy concrete. The iron inserts can be introduced into the pre-fabricated elements later, for example, by being inserted into horizontal holes that connect the channels or when the elements are first formed. After the channels have been filled this solution too represents a tension resistant connection. A combination of possibilities mentioned above is also possible. The suggestions numbered 1 to 4 above are more advantageous at least since they provide a connection between elements over the whole surface of the lateral edges of the two adjacent element in the wall.

The use of light concrete with a low modulus of elasticity has another unexpected advantage. The construction elements, according to the present invention, are always capable of absorbing moisture from its surroundings, and are wetted during strong rain. This results in an interruption of the shrinkage process, or at least disrupts that shrinking process, and additional tensile stresses are built up in the building element in dependence of its moisture absorption.

The building elements withstand such inner tensile stresses without any change or damage, which in turn is also due to their special properties, such as, for example their low modulus of elasticity.

Figure 6:
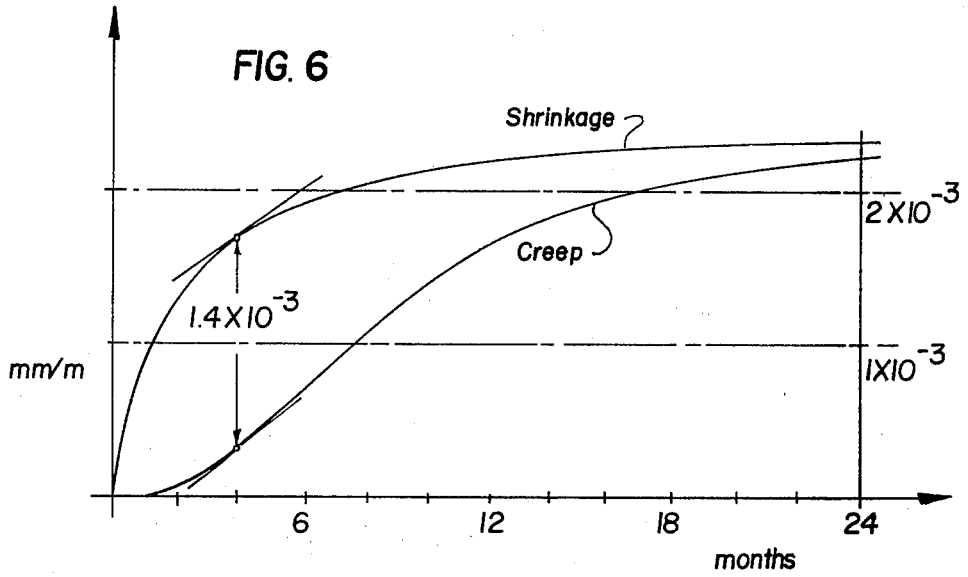
FIG. 6 is a graph showing the amount of plastic deformation or creep occurring in pre-fabricated elements of the invention over time and how it relates to the amount of shrinkage of the elements.
Figure 7:
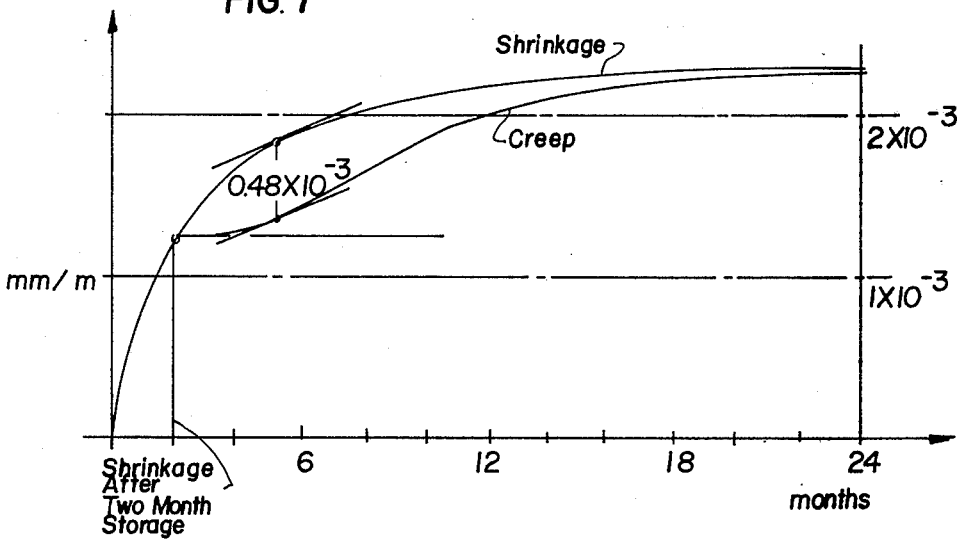
FIG. 7 shows a transposed creep curve in accordance with the invention.

FIG. 5, and already noted, a lightweight concrete element will shrink with time such that during the initial three months the shrinkage is quite substantial and thereafter the amount of shrinkage asymptotically approaches a final value representing the total amount of shrinkage for a block under constant conditions of humidity and temperature. If newly formed concrete elements are prevented from contracting, as the shrinkage occurs, by, for example being mounted in the frame work of a building, internal stresses will build up within the elements. These stresses will cause the elements to creep, that is plastically deform, in the manner shown by the creep curve in FIG. 6. It will be seen that the gap between the creep curve and the shrinkage curve is quite large and the elasticity of the concrete elements is sufficient to compensate for this gap so the elements will therefore crack. On the other hand, if the concrete elements are stored for about ninety days, as shown in FIG. 5, approximately 70% of the total amount of shrinkage occurs. If the so shrunk elements are then placed in a wall and bonded together in accordance with the invention such that they cannot contract further, the small amount of residual shrinkage does produce internal stresses in the concrete, however, the creep curve, instead of starting from the original length of the concrete elements, starts from the length they have when they have shrunk by 70% of their total shrinkage. Such a transposed creep curve is shown in FIG. 7. In this case, the gap between the creep curve and the shrinkage curve is very much less than is the case when the elements are constrained from contraction immediately after their formation. This smaller gap of $0.48\times10^{-3}$ mm/m can be compensated for by the elasticity in the lightweight concrete which has a low modulus of elasticity. Furthermore, any variations in length of the elements due to changes in humidity and temperature can also be accommodated by the elastic movement within the concrete element.

Another effect is that as the heavy concrete is poured into the channels, the water from the heavy concrete diffuses into the lightweight concrete and further accelerates the creep process. It appears, however, that even in the absence of this additional water, provided the lightweight elements are stored or steam-hardened to cause them to shrink by approximately 70% of their total shrinkage, this acceleration of the creep due to the addition of water is not absolutely essential. The example disclosed in the present application was in fact tested on a test-rig in which no water was added. The concrete was allowed to stand for 24 months to determine its shrinkage in the absence of tensile stress. It was also held under tensile stress to determine the total amount of creep. The 0.4 mm/m creep mentioned above occurred on this test rig even in the absence of water.

The basic concept of the invention thus, is to form a load-bearing wall of the lightweight concrete elements which themselves have a low modulus of elasticity and therefore a low compressive strength. The elements are bonded together by filling grooves in their abutting edges with heavy concrete which form pillars. Owing to the very high modulus of elasticity of heavy concrete, and consequently high compressive strength, the major part of any load applied to the wall is borne by the so formed concrete pillars. The surprising result is that, although the building elements tend to shrink, they do not crack because the internal stresses produce creep and elastic expansion, the sum of which exceeds the amount by which the elements have a tendency to shrink, provided the elements are steam-hardened or stored.

While specific embodiments of the invention have been shown and described in detail to illustrate the application of the principles of the invention, it will be understood that the invention may be embodied otherwise without departing from such principles.

What is claimed is:

1. A method of constructing a substantially crack-free load-bearing wall, comprising:

providing a plurality of substantially rectangular prefabricated building elements, each of light-weight concrete having a modulus of elasticity of less than 8000 kg/cm$^2$ which have been previously shrunk by at least one of, steam hardening and storage for a selected period of time each of the elements having a lengthwise groove formed in each longitudinal side edges thereof;

arranging the elements side-by-side so that the longitudinal side edges of adjacent are in abutting relationship and said grooves form vertical channels between adjacent elements;

and subsequently filling the so formed channels with heavy concrete to provide a tensile-resistant bond between adjacent elements and to form pillars which carry the major part of a load applied to the wall;

said previous shrinkage of said elements being such that the residual shrinkage of the elements is accommodated by creep occurring in the elements and by the elastic expansion thereof.

2. A method according to claim 1, wherein said previous shrinkage caused by at least one of steam hardening and storage amounts, to at least 70% of the total amount of shrinkage which would occur over a period sufficiently long for the shrinkage substantially to cease.

3. A method according to claim 1, wherein said light-weight concrete includes expanded polystyrene.

4. A method according to claim 1, wherein the modulus of elastic of the light-weight concrete is 4000 kg/cm$^2$.

5. A method according to claim 1, wherein the pre-fabricated elements are formed with longitudinal channels extending therethrough.

6. A method according to claim 5, wherein at least some of the longitudinal channels extending through the building elements are filled with heavy concrete after arranging the elements side-by-side to form additional load carrying pillars.

7. A method according to claim 1, wherein the surface of the grooves of the building elements are activated to increase their adhesion with the heavy concrete.

8. A method according to claim 7, wherein the building elements are activated by roughening.

9. A method according to claim 7, wherein the building elements are activated by applying a layer of adhesive.

10. A substantially crack-free load-bearing wall, comprising a plurality of substantially rectangular pre-fabricated building elements of light-weight concrete having a modulus of elasticity less than 8000 kg/cm$^2$ which have been previously shrunk by steam-hardening or storage, said elements having a lengthwise groove formed in each of their longitudinal side edges, said elements further being arranged side-by-side so that the longitudinal side edges of adjacent elements are in abutting relationship and said grooves form vertical channels between adjacent elements, said channels being filled with heavy concrete to provide a tensile-resistant bond between adjacent elements and to form pillars in said channels which carry the major part of a load applied to said wall, said previous shrinkage of said pre-fabricated elements being such that the residual shrinkage of the elements is accommodated by creep occurring in the elements and by elastic expansion thereof.

11. A wall according to claim 10, wherein said previous shrinkage of the pre-fabricated elements caused by steam-hardening or storage amounts to at least 70% of the total amount of shrinkage which would occur over a period sufficiently long for the shrinkage substantially to cease.

12. A wall according to claim 10, wherein said light-weight concrete includes expanded polystyrene.

13. A wall according to claim 10, wherein the modulus of elasticity of the light-weight concrete is 4000 kg/cm$^2$.

14. A wall according to claim 13, wherein the light-weight concrete has the following approximate composition per cubic meter:

| | |
|---|---|
| 1100 l | foam polystyrene particles |
| 340 kg | cement |
| 40 kg | fine sand |
| 130 l | water |
| 0.135 kg | adhesive material |
| 0.365 kg | hardener |

15. A wall according to claim 10, wherein the pre-fabricated elements are provided with longitudinal channels extending therethrough.

16. A wall according to claim 15, wherein at least some of the longitudinal channels extending through the building elements are filled with heavy concrete to provide additional load-carrying concrete pillars.

17. A wall according to claim 10, wherein each building element is provided with a rim projecting vertically beyond an upper edge surface thereof.

18. A wall according to claim 10, wherein the surfaces of the grooves are bond activated to increase their adhesion with the heavy concrete.

19. A wall according to claim 18, wherein said surfaces are roughened.

20. A wall according to claim 18, wherein said surfaces are coated with an adhesion layer to improve adhesion to the heavy concrete.

21. A wall according to claim 15, wherein the longitudinal channels extending through the wall are arranged asymmetrically with respect to a dividing plane of symmetry of the building elements.

22. A wall according to claim 10, wherein said grooves on each of said elements are arranged asymmetrically with respect to a dividing plane of symmetry of the building elements.

* * * * *